US009062840B2

(12) United States Patent
Swisha et al.

(10) Patent No.: US 9,062,840 B2
(45) Date of Patent: Jun. 23, 2015

(54) COVE LIGHTING

(71) Applicant: Electrix, LLC, New Haven, CT (US)

(72) Inventors: Gordon L. Swisha, Fairfield, CT (US); Joseph J. LoMenzo, West Babylon, NY (US)

(73) Assignee: Electrix, LLC, New Haven, CT (US)

( * ) Notice: Subject to any disclaimer, the term of this patent is extended or adjusted under 35 U.S.C. 154(b) by 105 days.

(21) Appl. No.: 13/901,526

(22) Filed: May 23, 2013

(65) Prior Publication Data

US 2013/0314907 A1 Nov. 28, 2013

Related U.S. Application Data

(60) Provisional application No. 61/651,246, filed on May 24, 2012.

(51) Int. Cl.

| | |
|---|---|
| ***F21S 8/00*** | (2006.01) |
| ***F21V 21/02*** | (2006.01) |
| *F21Y 103/00* | (2006.01) |

(52) U.S. Cl.

CPC ..... *F21S 8/033* (2013.01); *F21V 21/02* (2013.01); *F21Y 2103/00* (2013.01)

(58) Field of Classification Search

CPC ..... F21S 8/033
USPC ..... 362/147, 145, 368, 217.1, 211.11, 362/217.14, 217.16; 29/428
See application file for complete search history.

(56) References Cited

U.S. PATENT DOCUMENTS

| | | | | |
|---|---|---|---|---|
| 4,725,931 | A * | 2/1988 | Bourdon | 362/151 |
| 4,881,156 | A | 11/1989 | Shemitz et al. | |
| 5,343,375 | A * | 8/1994 | Gross et al. | 362/248 |
| 5,550,725 | A | 8/1996 | Shemitz et al. | |
| 5,775,797 | A * | 7/1998 | Henstra | 362/225 |
| 7,029,143 | B2 * | 4/2006 | Kiechle et al. | 362/147 |
| 7,249,870 | B1 * | 7/2007 | Shwisha | 362/368 |
| 7,658,518 | B2 | 2/2010 | Shwisha | |
| 8,002,426 | B2 * | 8/2011 | Pearson et al. | 362/152 |
| 8,398,273 | B2 * | 3/2013 | Eberhardt | 362/300 |
| 2005/0225982 | A1 * | 10/2005 | Hahn | 362/252 |

OTHER PUBLICATIONS

Edgeless Cove Light, 2009, Whitegoods Lighting Limited, London, GB.
Edgeless Cove—Quick Spec Form, 2011,Whitegoods Lighting Limited, London, GB.
Edgeless Installation Instructions, 2012, Whitegoods Lighting Limited, London, GB.
KE Series—Architectural trimless channel lighting system, 2010, Cooper US, Inc., Houston, TX.

* cited by examiner

*Primary Examiner* — Ali Alavi
(74) *Attorney, Agent, or Firm* — Bachman & LaPointe, P.C.

(57) ABSTRACT

A light apparatus is mounted to a surface of a building. The apparatus has at least one elongate mounting extrusion engaged to the surface. At least one elongate trim extrusion is mounted to the mounting extrusion and extending forward therefrom. The trim extrusion has a forward edge and an upwardly and rearwardly sloping surface extending from the edge. At least one light source is mounted to at least one of the mounting extrusion and trim extrusion.

32 Claims, 14 Drawing Sheets

COVE LIGHTING

CROSS-REFERENCE TO RELATED APPLICATION

Benefit is claimed of U.S. Patent Application Ser. No. 61/651,246, filed May 24, 2012, and entitled "Cove Lighting", the disclosure of which is incorporated by reference herein in its entirety as if set forth at length.

BACKGROUND OF THE INVENTION

The invention relates to electric lighting. More particularly, the invention relates to light fixtures for indirect lighting.

Well-developed fields exist in indirect lighting and architectural lighting fixtures. A particular area of indirect lighting is known as cove lighting. In a typical cove lighting situation, an upwardly open channel structure is built along a wall near the ceiling. The wall may be a side wall of the room, a sidewall of a recess in the ceiling, a side surface of a beam, or the like. Light bulbs are mounted within the channels so that the emitted light escapes generally upward to directly light the wall and ceiling above and, indirectly, an interior of the room and its contents. The channels are built with conventional building techniques involving framing, sheetrocking/plastering, and the like.

Alternatives involve elongate fixtures used for cove lighting. Such fixtures typically include an elongate bulb within an elongate reflector positioned so that light from the bulb and reflector does not directly pass to objects within a room but, rather, is first diffusely reflected from a ceiling, wall, or other architectural feature. Such fixtures may be assembled end-to-end in lieu of placing fixtures within a preexisting channel. Exemplary systems are shown in U.S. Pat. Nos. 4,881,156, 5,550,725, 7,249,870 and 7,658,518. Although its prior art status is unclear, a so-called "edgeless cove" lighting system from Whitegoods Lighting Ltd. has a tapering edge extrusion having a recess which receives wallboard forming the underside of the cove perimeter.

SUMMARY OF THE INVENTION

Accordingly, one aspect of the invention involves a light apparatus mounted to a surface of a building. The apparatus has at least one elongate mounting extrusion engaged to the surface. At least one elongate trim extrusion is mounted to the mounting extrusion and extends forward therefrom. The trim extrusion has a forward edge and an upwardly and rearwardly sloping surface extending from the edge. At least one light source is mounted to at least one of the mounting extrusion and trim extrusion.

Another aspect of the invention involves a light apparatus having at least one light source. First means is installable to a building wall for mounting a remainder of the apparatus to the wall. Trim means presents a rearwardly-diverging edge portion.

Another aspect of the invention involves a method for assembling a light apparatus to the surface of a building. At least one mounting extrusion is screwed to the surface. At least one trim extrusion is downwardly hinged to the at least one mounting extrusion. A plurality of light sources are assembled to at least one of the trim extrusions and mounting extrusions.

Another aspect of the invention involves a light apparatus comprising at least one light source. First means is installable to a vertical surface of a blocking member, the cove wall of a building for mounting a remainder of the apparatus to the wall and for receiving a skim coat across a junction with a wallboard member. Trim means is mountable to the first means.

Another aspect of the invention involves a method for assembling a light apparatus to a vertical surface of a blocking member of a cove of a wall of a building. At least one mounting extrusion is secured to the surface. At least one trim extrusion is mounted to the at least one mounting extrusion. A plurality of light sources are assembled to at least one of the trim extrusions and the mounting extrusions. At least a wallboard piece is secured above the mounting extrusions.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
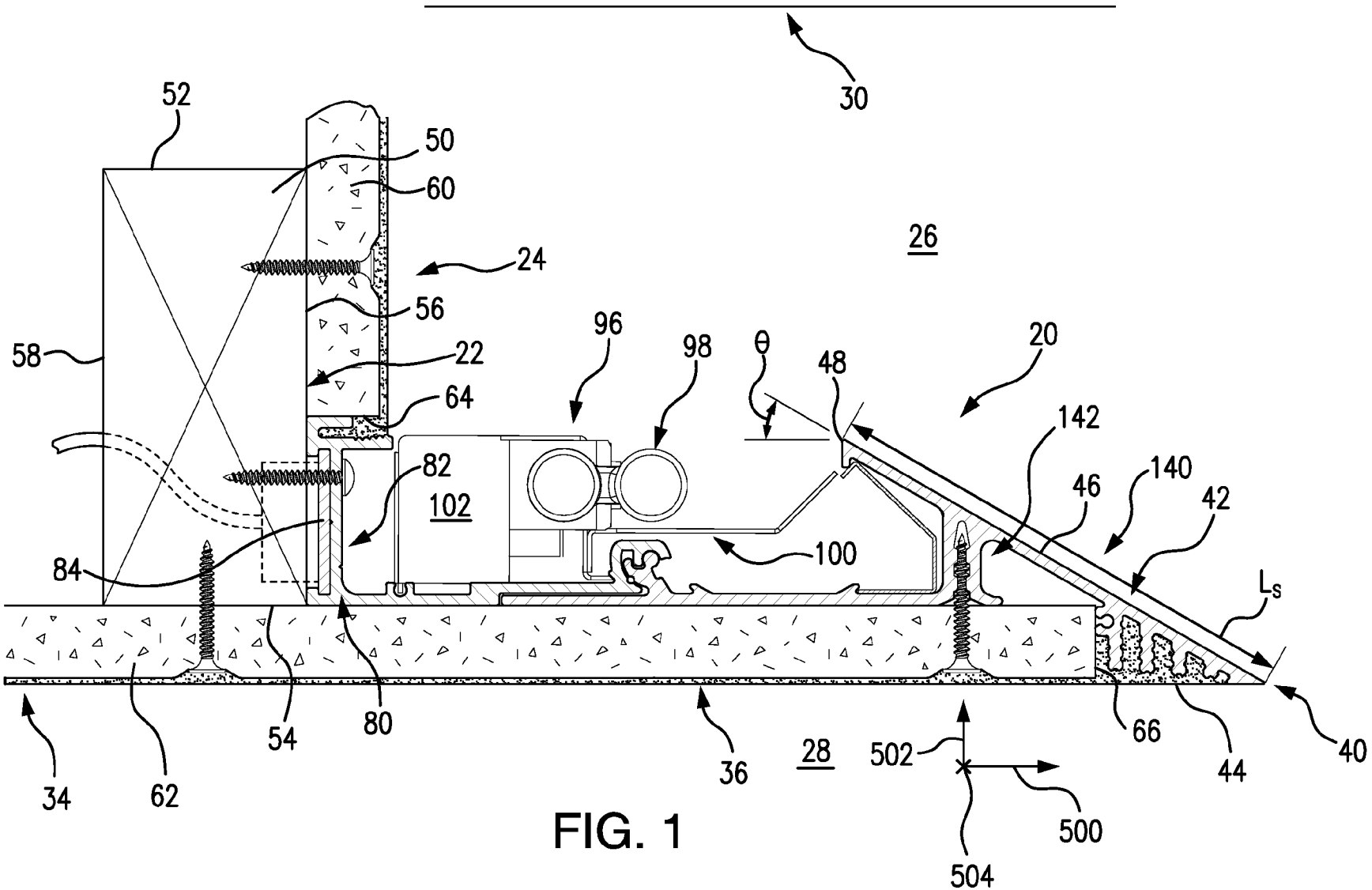
FIG. 1 is a sectional view of a first light fixture installed.

FIG. 1 shows a light fixture assembly 20 mounted to a surface 22 of a wall 24. The wall may be a wall of a room, a wall of a ceiling cove 26, a side of a structural beam, or the like or combinations. The exemplary cove 26 is above a main portion 28 of the room. The fixture assembly may be positioned adjacent to and slightly below a ceiling or ceiling portion 30. For convenient reference, a forward direction 500 is defined as away from the wall. An upward direction is shown as 502. With left and right defined from the point of view of a person standing upright and facing in the forward direction, the fixture assembly may extend from a left end to a right end. The assembly may include one, two, or more individual fixture units or subsystem units assembled or otherwise arranged end-to-end. This bi-direction 504 of assembly is identified as longitudinal. In the exemplary cove mounting situation, the ceiling portion 30 is along the cove 26 and a ceiling portion 34 is laterally beyond the cove.

The exemplary fixture assembly provides the appearance of an integral part of the building. In the exemplary implementation, at least portions of the fixture assembly are installed prior to installation of adjacent wallboard, finish plastering, and the like. Specifically, the exemplary fixture assembly presents a continuation 36 of the ceiling 34 beyond the cove with the continuation extending across the opening of the cove 26. The fixture further presents an aesthetically sharp edge (corner when viewed in section) 40 at the cove opening. The exemplary fixture further provides a tapering region 42 rearwardly diverging from the edge 40. The exemplary tapering region 42 has an underside 44 and an upper surface 46. In the exemplary implementation, the underside 44 is generally horizontal whereas the upper surface 46 extends off horizontal at an angle θ. The exemplary surface 46 has a length $L_S$ (when measured in transverse section from the edge 40 to a rear end/edge 48). Exemplary $L_S$ is 50-200 mm, more particularly, 80-150 mm. An exemplary θ is 20-50°, more narrowly, 30-45°.

The exemplary fixture assembly 20 is shown in an exemplary mounting situation mounted (e.g., screwed) directly to a blocking member 50 forming a lower forward edge of a wall substructure of the cove wall. The exemplary blocking member 50 is a piece of dimensional lumber (or metallic substitute) transversely horizontally extending (e.g., in the longitudinal directions of the fixture). The exemplary blocking member may be mounted to additional framing members (not shown). The exemplary blocking member 50 has, in section, an upper surface (top) 52, a lower surface (underside) 54, a front surface 56, and a rear surface 58. In the exemplary implementation, wallboard 60 (e.g., gypsum board, plasterboard, or the like) of the wall 24 (providing a lateral wall/perimeter of the cove) extends partially along the front face 56 and wallboard 62 extends along the lower face 54 (providing the ceiling outboard of the cove). The exemplary wallboard 60, in vertical section, extends from an upper edge (not shown) to a lower edge 64 and has front and aft surfaces. Similarly, the wallboard 62 extends from a rear edge (not shown) to a front edge 66 and has upper and lower surfaces. In the longitudinal direction 504, the wallboard 60 and 62 may be represented by multiple edge-to-edge pieces ultimately secured via conventional techniques.

The assembly 20 may comprise several subsystems. A first exemplary subsystem is a wall-mounting subsystem 80. The exemplary subsystem 80 includes an end-to-end array of mounting members 82. Exemplary mounting members 82 are extrusions (e.g., of an aluminum alloy) having a convoluted profile so as to form the gross features shown and described. Adjacent twos of the members 82 are joined by connector plates 84 (e.g., aluminum, steel, or plastic) spanning their junctions. The members 82 may be secured to the wall 24 by fasteners 86 (FIG. 2, e.g., screws, toggle fasteners, or the like). Further structural details of the exemplary subsystem 80 and members 82 are discussed below. In this particular implementation, the members 82 are secured to a lower portion of the forward surface 56 of the blocking member proximate the lower surface 54.

A second subsystem is an electrical subsystem 90 (FIG. 1). The exemplary electrical subsystem includes a light source. An exemplary light source may include one or more receptacles. The exemplary electrical subsystem includes units having aft and front receptacles 96 carrying bulbs 98 (e.g., "seamless"-type fluorescent tubes) for emitting light. The receptacles are mounted on and carried by a gear tray 100 which in the exemplary embodiment is attached to the wall-mounting subsystem. In FIG. 1, a ballast 102 is shown carried by the tray 100. Receptacle/tray/ballast combinations may be longitudinally arrayed end-to-end. In several alternative variations, a single ballast may power more than just the adjacent bulb(s). In other variations, there may be more complex interrelationship of the bulbs such as longitudinal staggering of receptacles for conventional tubes to reduce dark spots. Various permutation of known and unknown electrical connections may be used to connect the ballasts to external power (potentially including various daisy chaining of individual units, slaving of individual units, and the like). Additionally, alternative light sources may include light emitting diode (LED) strips or other lighting technologies instead of fluorescent tubes.

A third subsystem is a trim subsystem 140 mounted to the wall-mounting subsystem and provides a structure for forming the edge 40 and tapering region 42. As is discussed further below, the exemplary trim subsystem 140 includes a plurality of extrusions 142 (e.g., also aluminum alloy) mounted to the extrusions 82.

Figure 2:
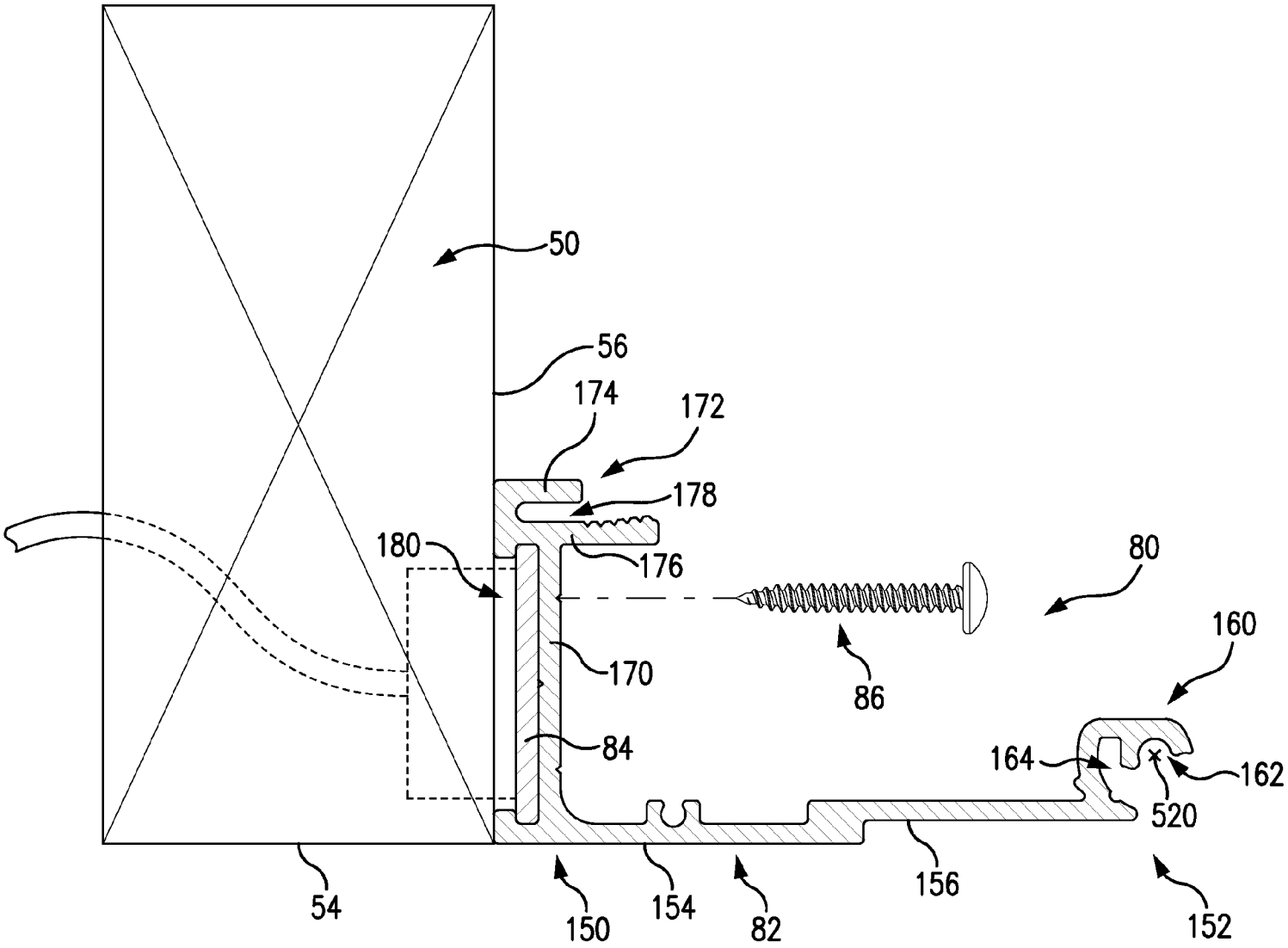
FIG. 2 is a sectional view of a mounting extrusion of the fixture of FIG. 1 in an initial stage of installation.

FIG. 2 shows further details of the extrusion 82. The exemplary extrusion 82 has a rear portion 150 for mating with the blocking member surface 56. The exemplary extrusion 82 has a forward portion 152 for mating with the associated trim extrusion(s). An underside of the extrusion 82 has an aft portion 154 then a portion 156 immediately forward thereof and upwardly offset/stepped. In the installed condition, the portion 154 is adjacent/flush to the blocking member underside 54. The stepping allows an aft portion of the extrusion(s) 142 to be accommodated by the step so that its underside is flush with the surface portion 154 and blocking member underside 54. At a forward end, the forward portion 152 includes a hinge moiety 160 for engaging a complementary moiety of the trim extrusion(s). The exemplary extrusion 82 (as extruded) at the moiety 160 defines a pivot channel 162 having an axis 520. Essentially coaxial with the channel 162 is an annular segment groove/channel 164 (discussed below).

The surface portions 154 and 156 are along the underside of a generally stepped lower horizontal web structure of the extrusion. In the portion 150, a vertical web 170 extends upward from the lower horizontal web to an upper rail structure 172 comprising an upper wall 174 and a lower wall 176 spaced therefrom by a channel 178. In the exemplary configuration, the web 170 connects to the wall 176 and is forwardly shifted from the surface 56 to define an open channel 180 having slightly inwardly protruding upper and lower rims so as to provide a slot for capturing the plates 84. As is discussed further below, surfaces of the walls 174 and 176 adjacent the channel 178 may be extruded with serrations for providing a biting engagement with skim coat. In installation, the rear portion of the mounting extrusion 82 is butted up against the surface 56 and one or more screws 86 are screwed through the web 70 and into the blocking member 50 or other structure. The extrusion 82 may be pre-formed (as extruded) with grooves vertically defining the screwing locations (e.g., for self-drilling screws or for aligning drill bits) or may be pre-drilled post extrusion.

Figure 4:
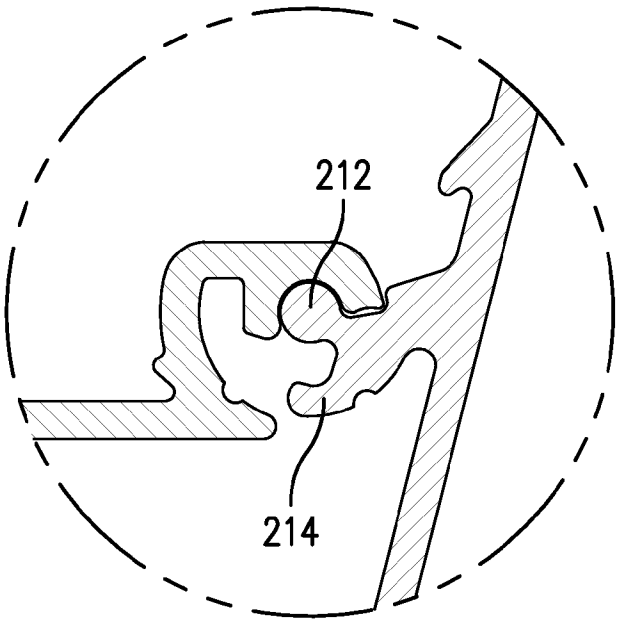
FIG. 4 is an enlarged view of a hinge junction of the extrusions of FIG. 3 in a further stage of installation.
Figure 3:
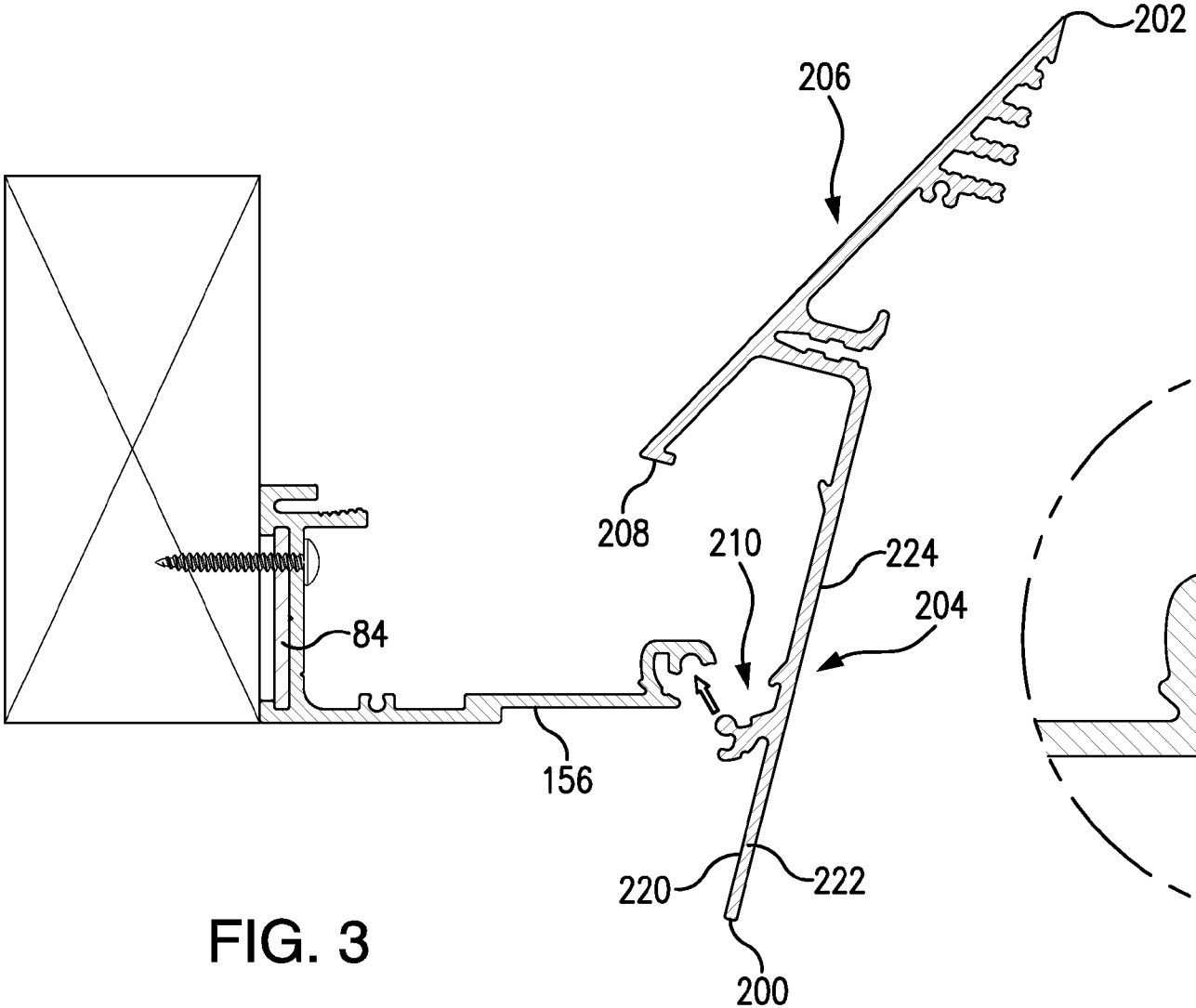
FIG. 3 is a sectional view of the mounting extrusion and a trim extrusion of the fixture of FIG. 1 in a subsequent stage of installation.
Figure 5:
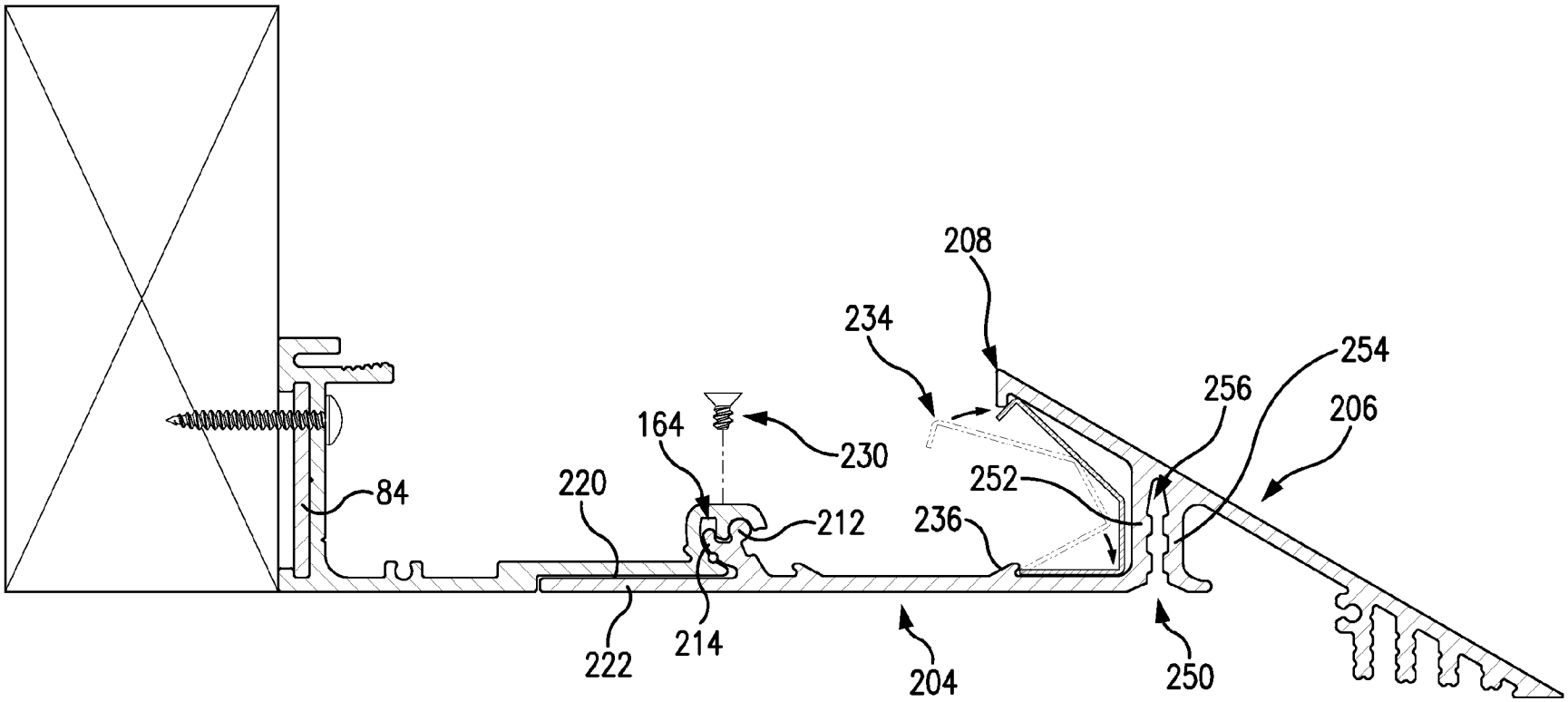
FIG. 5 is a sectional view of the extrusions in yet subsequent stages of installation.

FIG. 3 shows further details of the trim extrusion 142. Each trim extrusion extends from a rear edge 200 to a forward edge 202 (which defines the edge 40). A rear portion (when in the installed condition) 204 is formed as a horizontal web extending forward from the edge 200. An inclined wall 206 extends from the forward edge 202 to a rear edge 206 which defines the edge 48. In the exemplary embodiment, a hinge moiety 210 extends upward from the web 204 and includes a pivot bead 212 complementary to and receivable by the channel 162. A coaxial partially annular finger 214 is complementary to the channel/slot 164. During installation, the trim extrusion is angled front-up and shifted (translated) in a generally upward/rearward direction to insert the bead 212 into the channel 162 (FIG. 4). Thereafter, it is rotated front downward (clockwise as viewed in FIG. 5) to rotate the projection 214 into the channel 164. This rotation may be stopped by an upper surface 220 of the web 204 along a rear portion 222 thereof coming up against the surface portion 156 so that the rear portion 222 is accommodated by the step and the underside 224 of the web 204 is flush/coplanar with the surface portion 154. At this point, engagement of the projection 214 with an outer surface of the channel 164 prevents the trim extrusion from falling out of its installed position. The trim extrusion may, however, be further secured by fasteners such as screws 230 (FIG. 5). Exemplary screws 230 pass through pre-drilled holes in the hinge moiety 160 (e.g., through an upper web thereof) so that the end of the screw, when installed, locks between the bead 212 and the projection 214.

Figure 8:
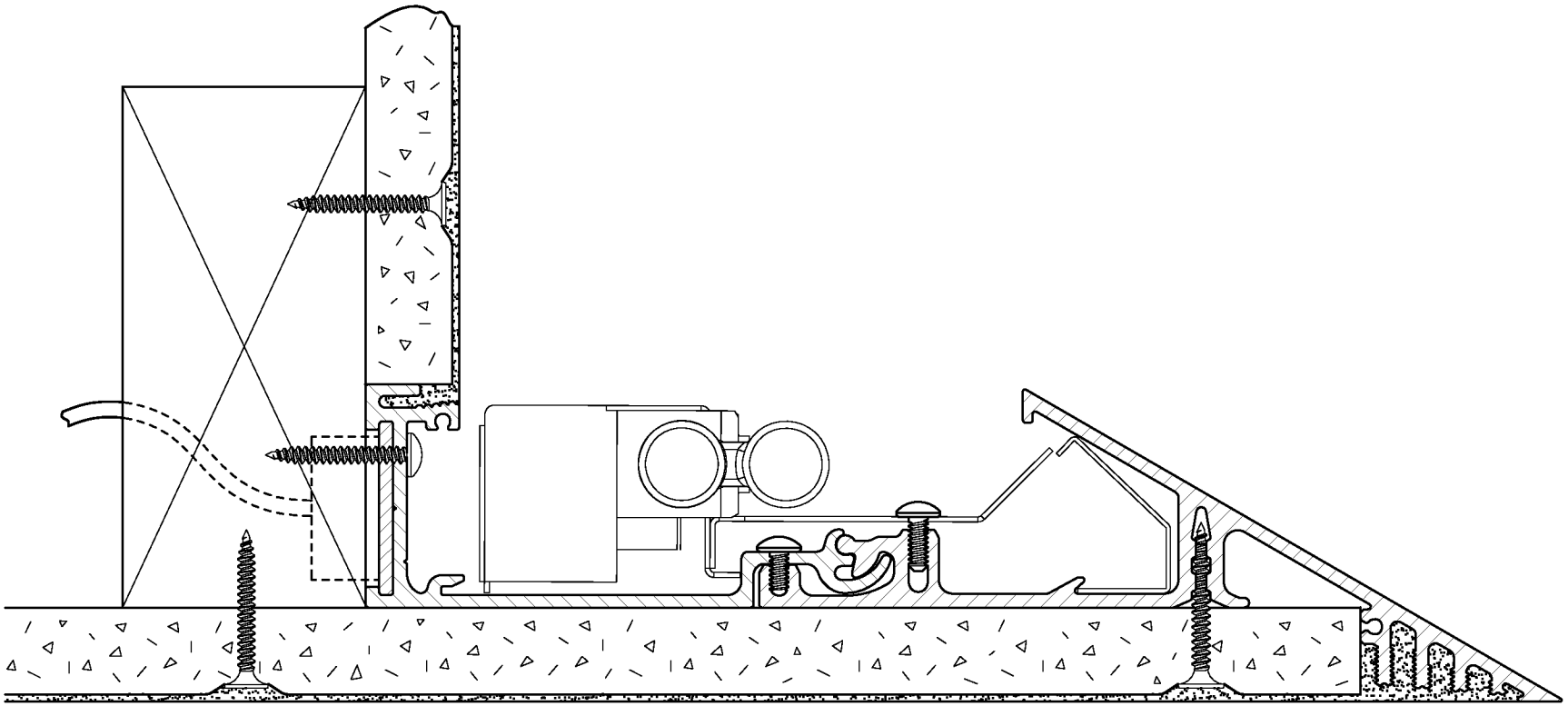
FIG. 8 is a sectional view of an alternate fixture installed.

A variation is shown in the cross-section of FIG. 8 wherein the geometry of the hinge moieties is altered to provide a rearward and downward mating translation of the trim extrusion followed by the front-downward rotation. The mounting extrusion moiety slot opens forwardly and slightly upwardly to receive a rearwardly-projecting bead/knuckle of the trim extrusion moiety. The trim extrusion moiety rear portion has an upwardly open serrated screw slot to receive a screw through (e.g. through a pre-drilled hole in the mounting extrusion). The mounting extrusion includes a forwardly open slot to receive a projection of the rear end of the tray. The tray projection may be inserted into the slot and the tray rotated front-downward into position (or may simply be downwardly installed and shifted rearward to engage projection and slot). Forward of the trim extrusion hinge moiety, the trim extrusion includes an upwardly open serrated screw slot for receiving screws to secure a forward projecting portion of the light tray(s).

When all the trim members are put in place, FIG. 5 further shows light blocking plates 234 (e.g., formed of sheets of spring steel or cold-rolled steel with pre-formed bend creases positioned across the gaps). In the particular embodiment, along the upper surface of the web 204, there is a forward barb 236 which accommodates a lower edge of the light blocking plate 234. An opposite portion of the light blocking plate is captured by a recess near the rear edge 208. The light blocking plates 234 and connector plates 84 may extend symmetrically across the junctions between their associated extrusions. Exemplary end-to-end lengths of such plates 234 and 84 may be of any appropriate size (e.g., from an exemplary 20 mm to an exemplary 200 mm).

Figure 6:
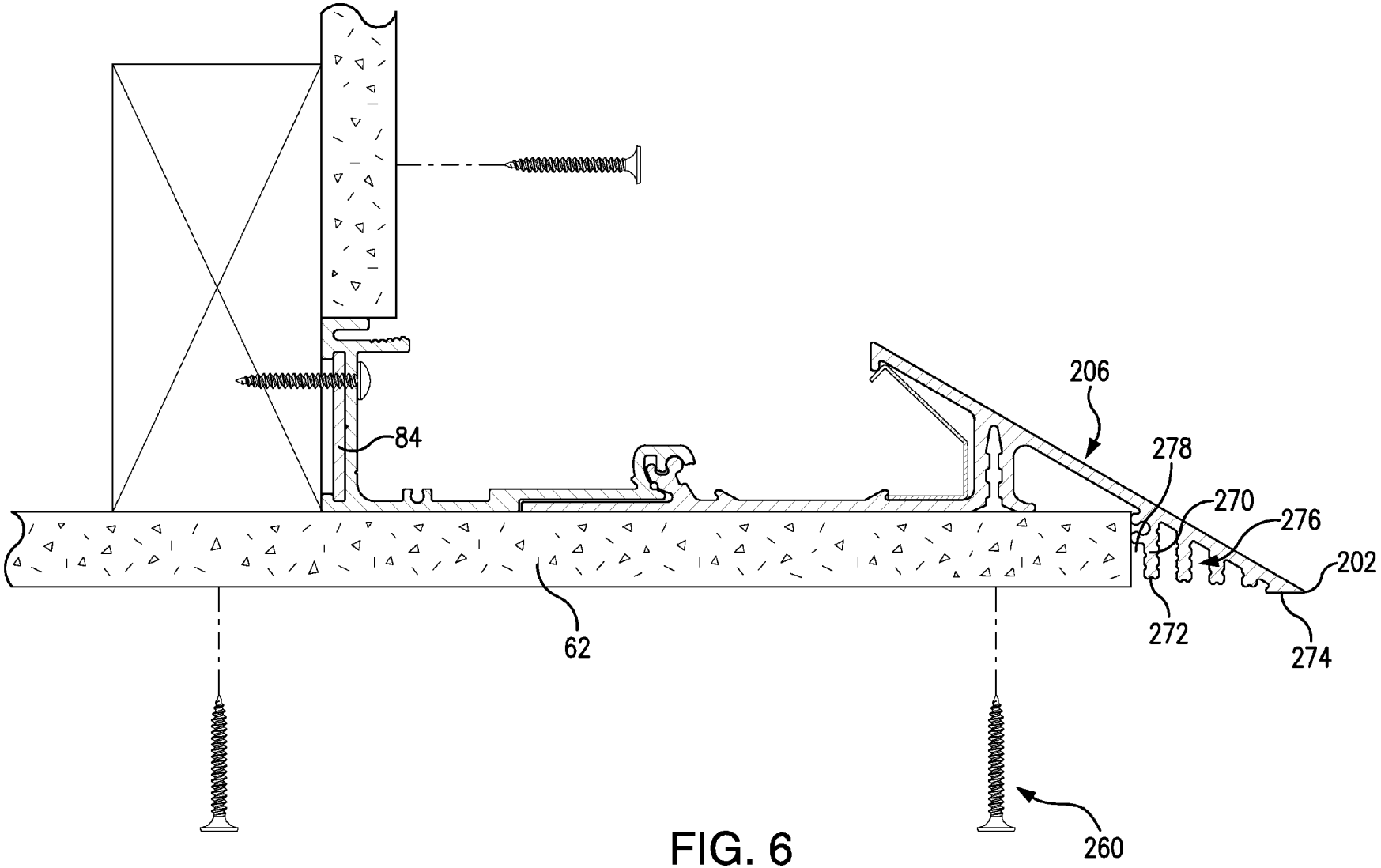
FIG. 6 is a sectional view of the extrusions in a subsequent stage of installation.

FIG. 5 further shows a channel structure 250 joining the web 204 to the inclined wall 206. The structure 250 is defined by an aft wall 252 joining a leading edge of the web 204 to the inclined wall 206 and a forward wall 254. The exemplary channel 256 between the walls 252 and 254 has a filleted/relieved opening/inlet and convoluted sides. The channel 256 serves for capturing fasteners 260 securing the wallboard 62 (FIG. 6).

Figure 7:
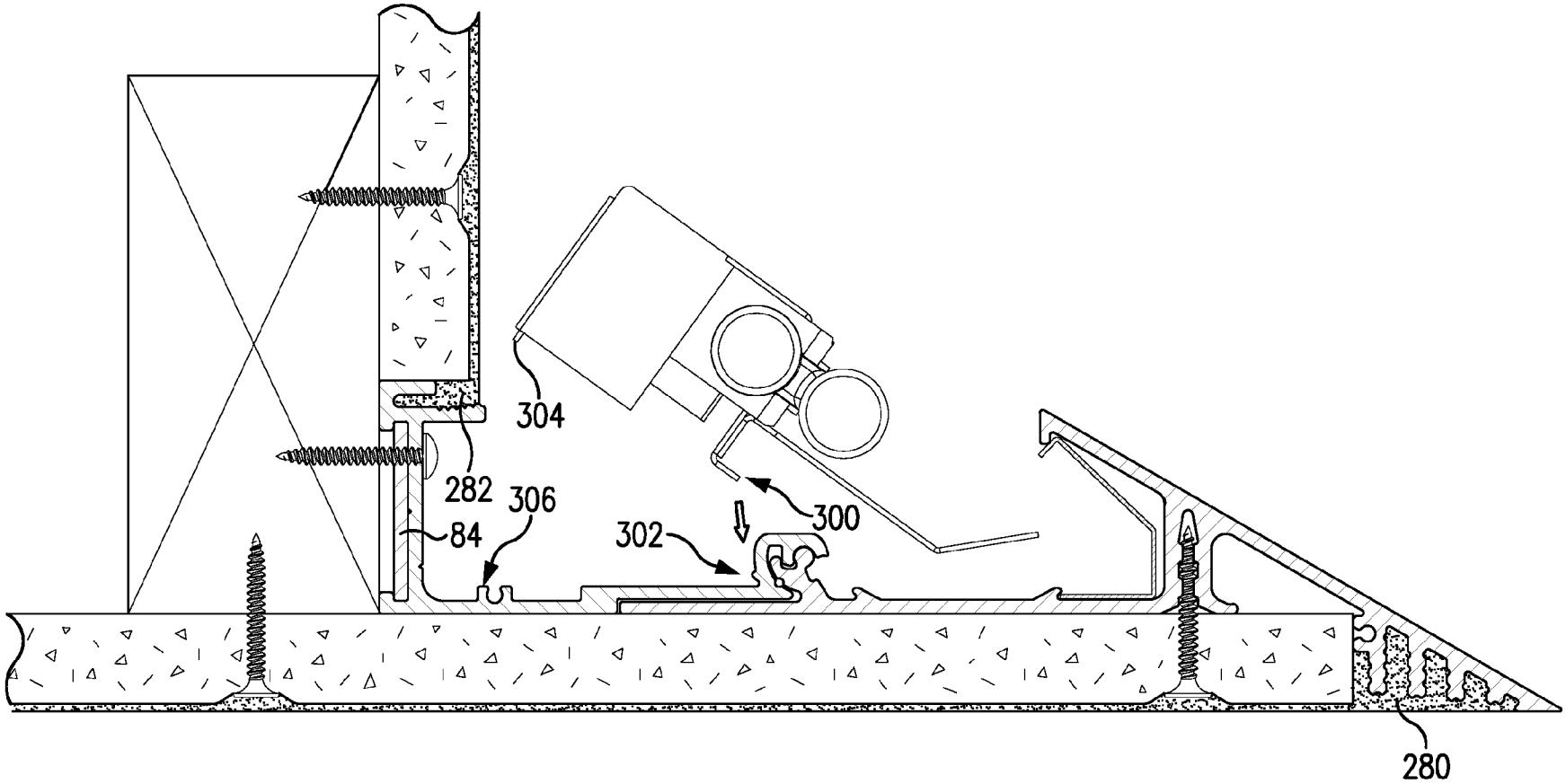
FIG. 7 is a sectional view of the extrusions and a lighting tray in a subsequent stage of installation.

Depending from the inclined wall 206 near the forward edge 202 are a plurality of walls 270 whose lower ends 272 are slightly vertically recessed above a flat surface 274 extending rearwardly from the edge 202. This vertical recessing and the channels 276 between the walls and a gap 278 aft of the trailing wall all provide volume for accommodating a skim coat 280 (FIG. 7) applied after the fastening of the wallboard 62. FIG. 7 also shows skim coat 282 extending into the channel 178 as discussed previously. Additional finishing steps may be as conventional in the dry walling art. FIG. 7 further shows the light unit being installed via a downward translation in an initially angled condition followed by a back-down rotation. The exemplary light units and mounting extrusions have interfitting features 300, 302, 304, and 306 for holding the light units in position. The exemplary feature 300 is a forwardly projecting sheetmetal foot captured in a recess 302 behind the hinge. The exemplary feature 304 is a depending vertical sheetmetal projection received in a vertically upwardly open channel 306.

For manufacturing and shipping purposes, the extrusions may be formed in one or more standard lengths. One exemplary length is standard US 8-foot length. If shorter pieces are required to complete a given leg of a system, these may be cut from the stock material. Alternatively, smaller standard sizes may also be provided such as 4-foot and 6-foot or their SI/metric equivalent for countries outside the US. In the exemplary system, the length and nature of the individual lighting trays may be influenced by the particular bulbs desired to be used. Trays may be assembled end-to-end and, therefore, do not have to correspond to length of the extrusions. The selection of trays and their arrangement may be made to provide even lighting along the length of any given leg or to provide a desired variation in light along that leg. Trays may overlap junctions between extrusions.

Exemplary depths between the fixture forward edge and the mounting surface of the blocking member are approximately 6-18 inches with particular examples in the range of 8-13 inches. For example, an exemplary 8.625 inch length when used with 0.625 inch wallboard results in an 8-inch protrusion. Thus, nominal protrusions of 8, 10, and 12 inches might be made available in a given series of fixtures. SI/metric equivalents could also be provided.

Figure 9:
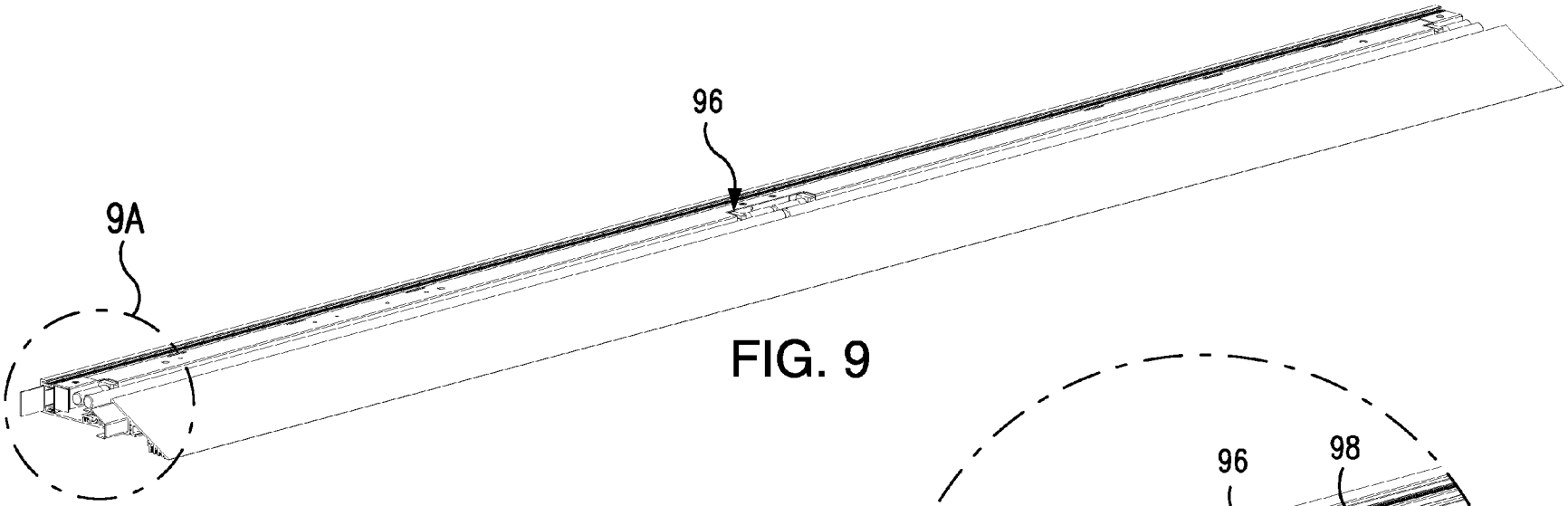
FIG. 9 is a view of the fixture of FIG. 8.
Figure 9A:
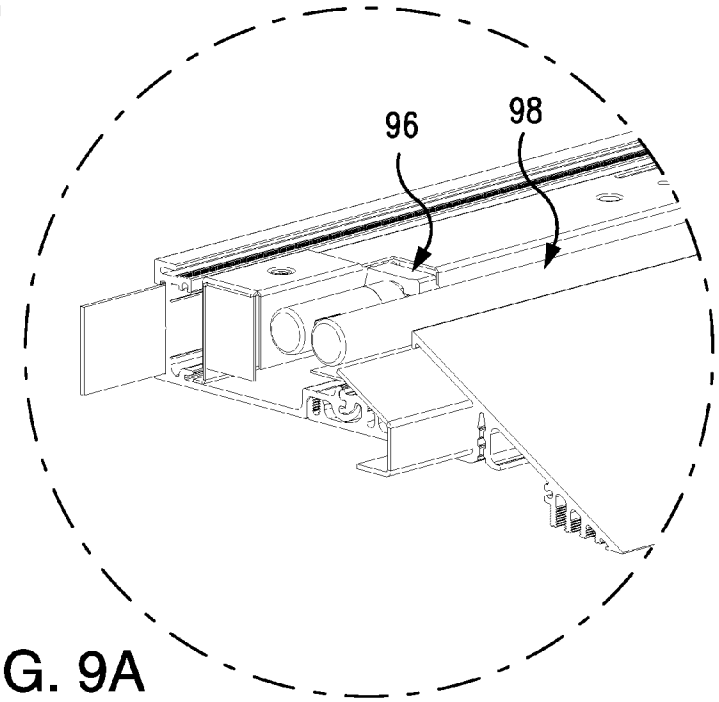
FIG. 9A is an enlarged view of an end portion of the fixture of FIG. 9.

FIGS. 9 and 9A show a given length of extrusion with light blocking and alignment members protruding from one end for mating with the adjacent opposite end of another such extrusion or corner piece. FIG. 9 also shows sockets/receptacles 96 for mating with seamless-style fluorescent tubes 98.

Figure 10:
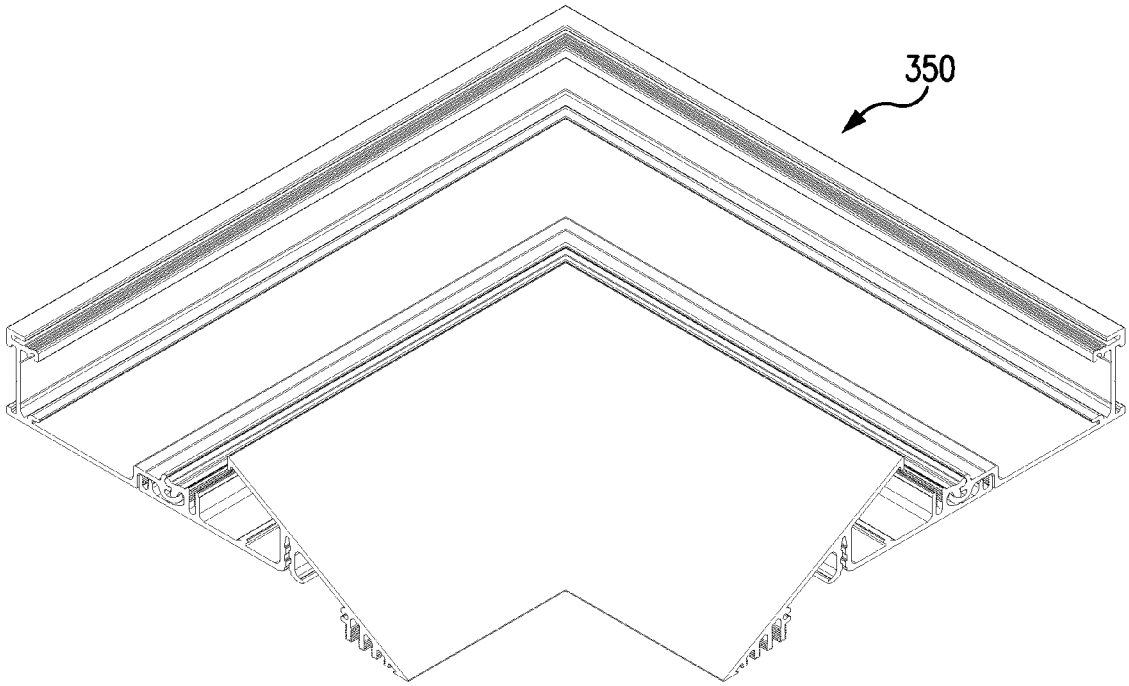
FIG. 10 is a view of a first internal corner assembly.
Figure 11:
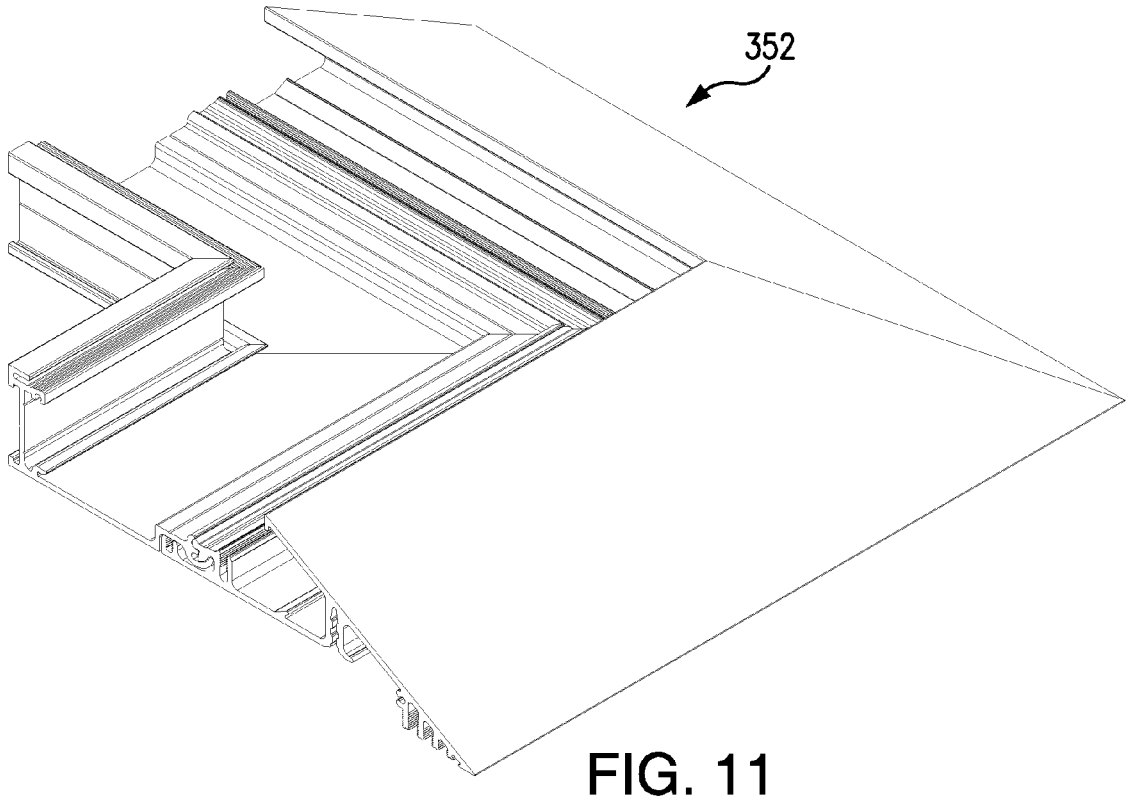
FIG. 11 is a view of a first external corner assembly.

In either of the exemplary systems, interior 350 (FIG. 10) or exterior 352 (FIG. 11) corners may be provided to join one mounting extrusion and trim extrusion pair to another such pair. These may be formed of the same as-extruded stock used for the mounting extrusions and trim extrusions. The two pieces may be secured to each other such as via screws and may be mitered to form the associated interior or exterior corner. Exemplary interior corners are 90 degree corners and exemplary exterior corners are 270 degree corners. However, other angles may be appropriate for other angles of wall intersections. The corner members may be attached to the adjacent extrusion pairs via similar mounting plates as are used to span the junctions of end-to-end pairs. For example, to form a 90 degree corner member, two pieces of the combined extrusion with opposite 45 degree cuts may be mated along those cuts and secured to each other. This securing may be via adhesive, welding, or brackets received in the channels of the extrusion (e.g., bent metal, brackets, or the like). Yet alternative embodiments of the corner pieces involve a single-piece extrusion replacing the mated two extrusion pieces. The single-piece extrusion might be extruded into the overall profile of a mated extrusion pair. Individual pieces could then be cut from this single piece extrusion and assembled to form the corner members.

The exemplary system may have a number of utilitarian advantages. One advantage is economy of contractors. For example, different contractors may serve different purposes. There may be a structural contractor who installs the building framing and the blocking members, a sheetrocking/plastering contractor for installing the sheetrock, a lighting installer, and an electrician (if not also the lighting installer). The exemplary system allows the lighting installer to install before the sheetrocker has done any work. This is distinguished, for example, from a situation wherein the sheetrocker must apply some sheetrock before the fixtures are installed and some sheetrock after the fixtures are installed. With the blocking member (or other structure) in place, the lighting installer (if different) may install at least the key structural portions of the lighting system. Thereafter, the sheetrocker may install the sheetrock, including the applying of the joint compound, depending on the situation, painting may then occur. The lighting trays may be installed and wired thereafter allowing them to avoid damage or contamination. This may, for example, allow use of spray paint without need to protect the light sources.

A second embodiment 400 (FIG. 12) differs from the first embodiment in terms of the underside of the cove structure presented. In this embodiment, the sheetrock 62 ends at the blocking member and the lighting system provides a smooth underside 402 flush with the underside of the sheetrock 62. In this embodiment, the rear portion of the mounting extrusion is positioned downwardly protruding from the underside of the blocking member by slightly less than the thickness of the sheetrock. Construction of the mounting extrusions and the trim extrusions is otherwise similar to the first embodiment except that the trim extrusion is characterized by a single bottom web having a smooth underside and extending essentially the full depth of the fixture (e.g., the stepped interaction is eliminated). When installed, the underside of the web of the trim extrusion is flush with the underside of the wallboard 62.

Figure 13:
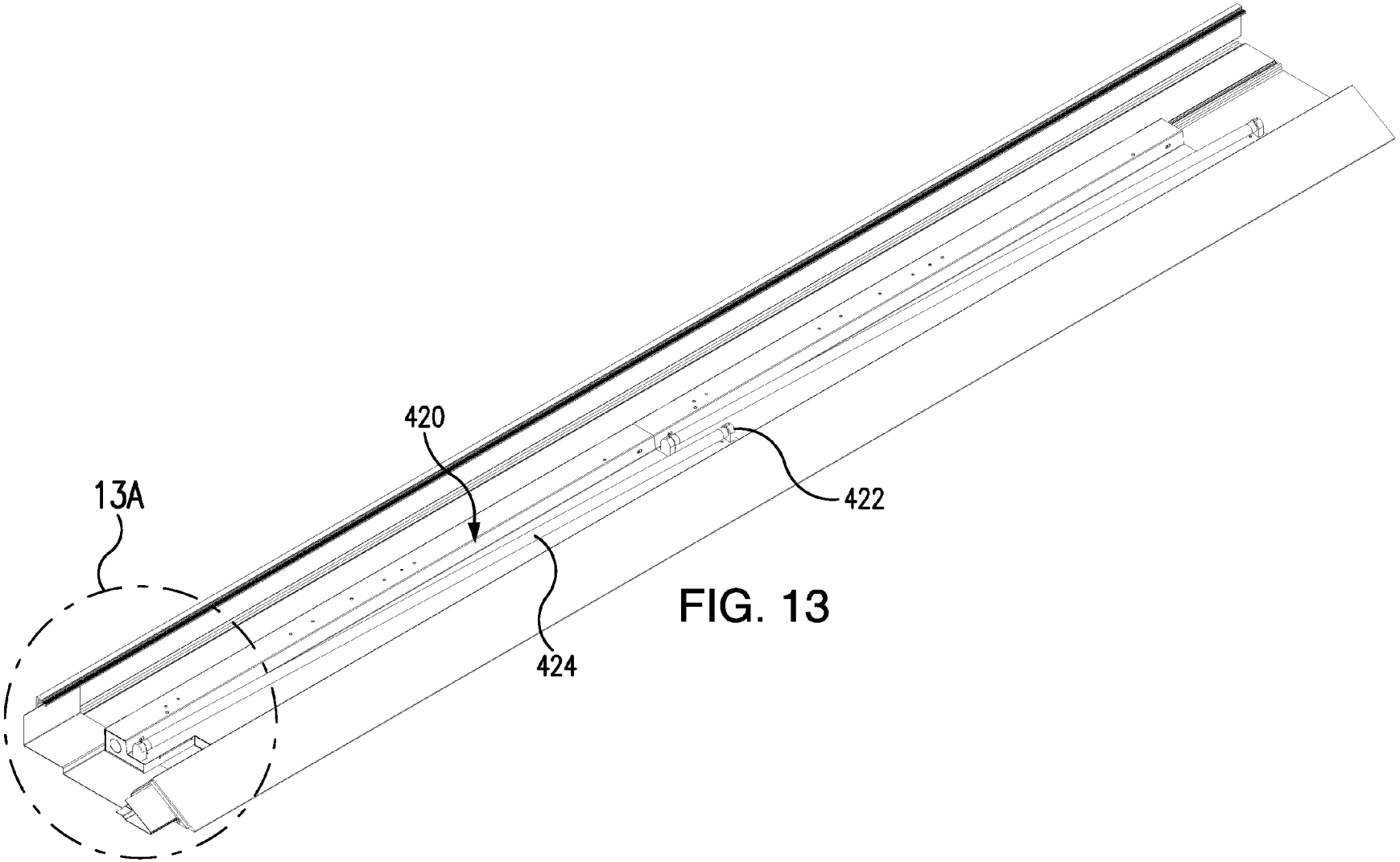
FIG. 13 is a view of the fixture of FIG. 12.
Figure 14:
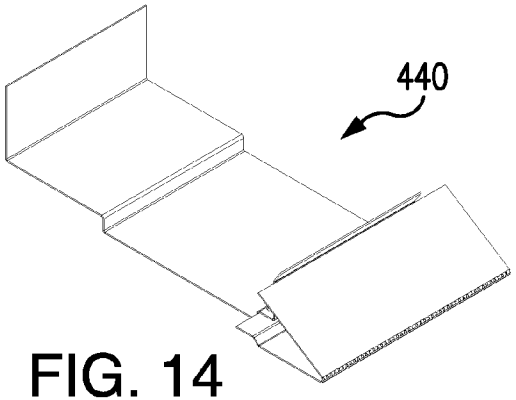
FIG. 14 is a view of an alignment clip for the fixture of FIG. 13.
Figure 15:
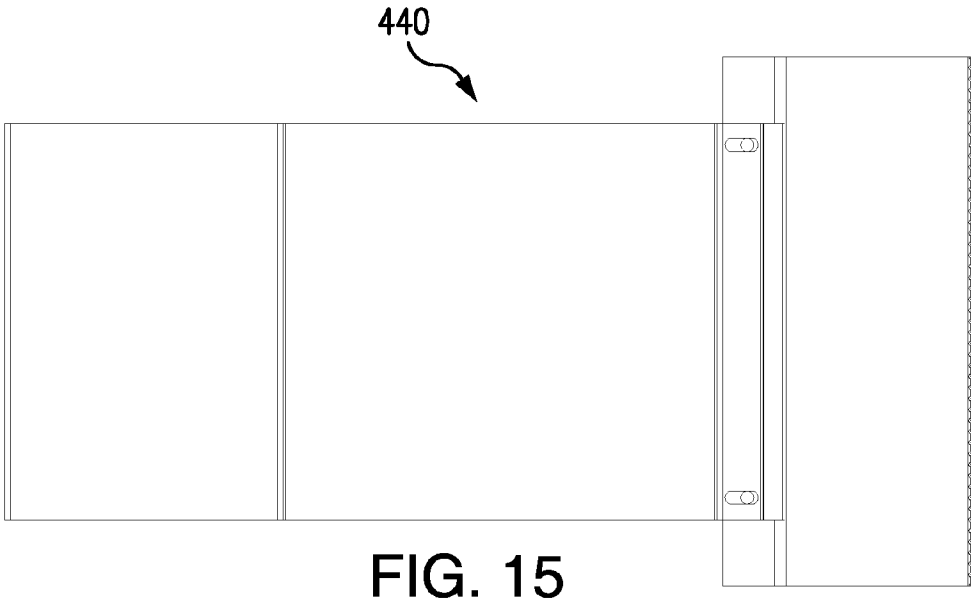
FIG. 15 is a top view of the alignment clip of FIG. 14.
Figure 13A:
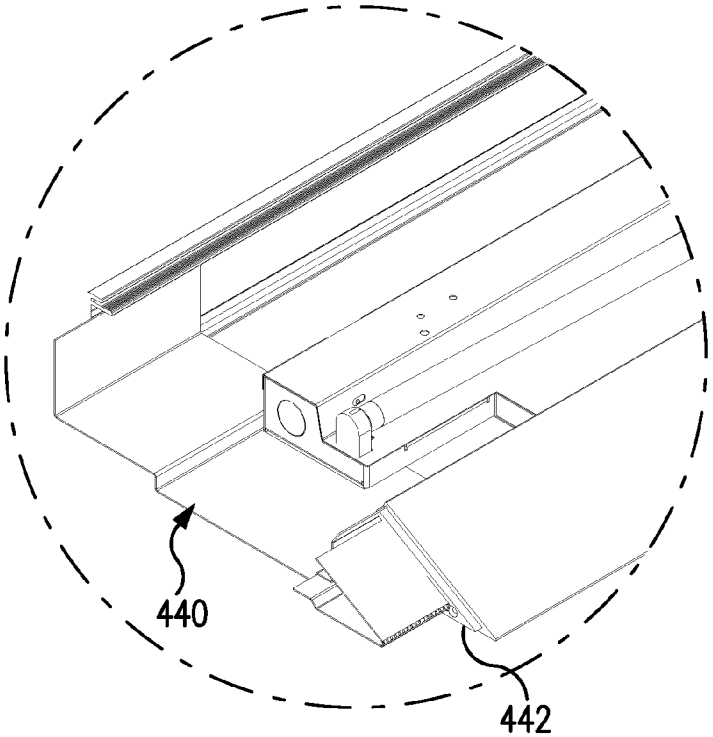
FIG. 13A is an enlarged view of an end portion of the fixture of FIG. 13.
Figure 16:
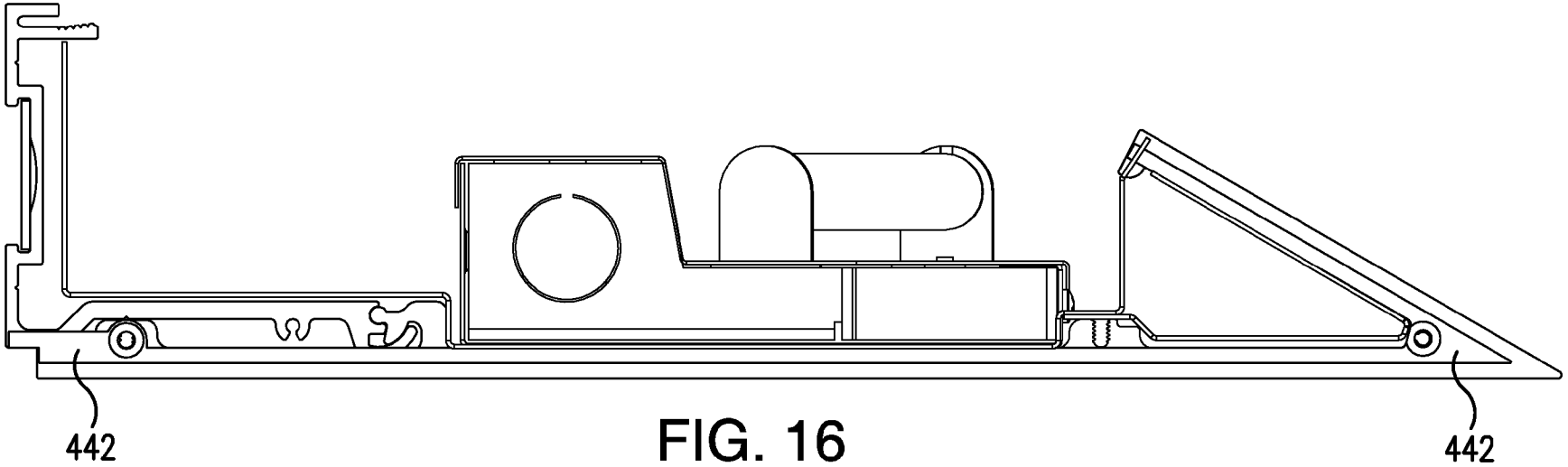
FIG. 16 is an end view of the fixture of FIG. 13.

FIG. 13 shows gear trays 420 having receptacles 422 slightly diagonally offset from each other so that the associated conventional fluorescent tubes 424 are slightly diagonal and, thereby, interleave at their adjacent ends to avoid dark spots. It can be seen that the gear trays may span junctions between extrusions. FIG. 13A also shows a combination alignment and light-blocking clip 440 which may be formed as a sheetmetal assembly interfitting adjacent ends of the adjacent extrusions. FIG. 13A also shows a reveal spacer 442 secured abutting the end faces of the extrusions along one end. The exemplary reveal spacer is fastened (e.g., screwed) to one of the two adjacent pair of extrusions so as to create a predetermined minimum space between adjacent fixtures (or a fixture and a corner). By creating this minimum spacing (e.g., 1-5 mm) slight variations in spacing caused by alignment issues are not as perceptible as if one endeavored to butt the extrusions directly end-to-end.

Figure 12:
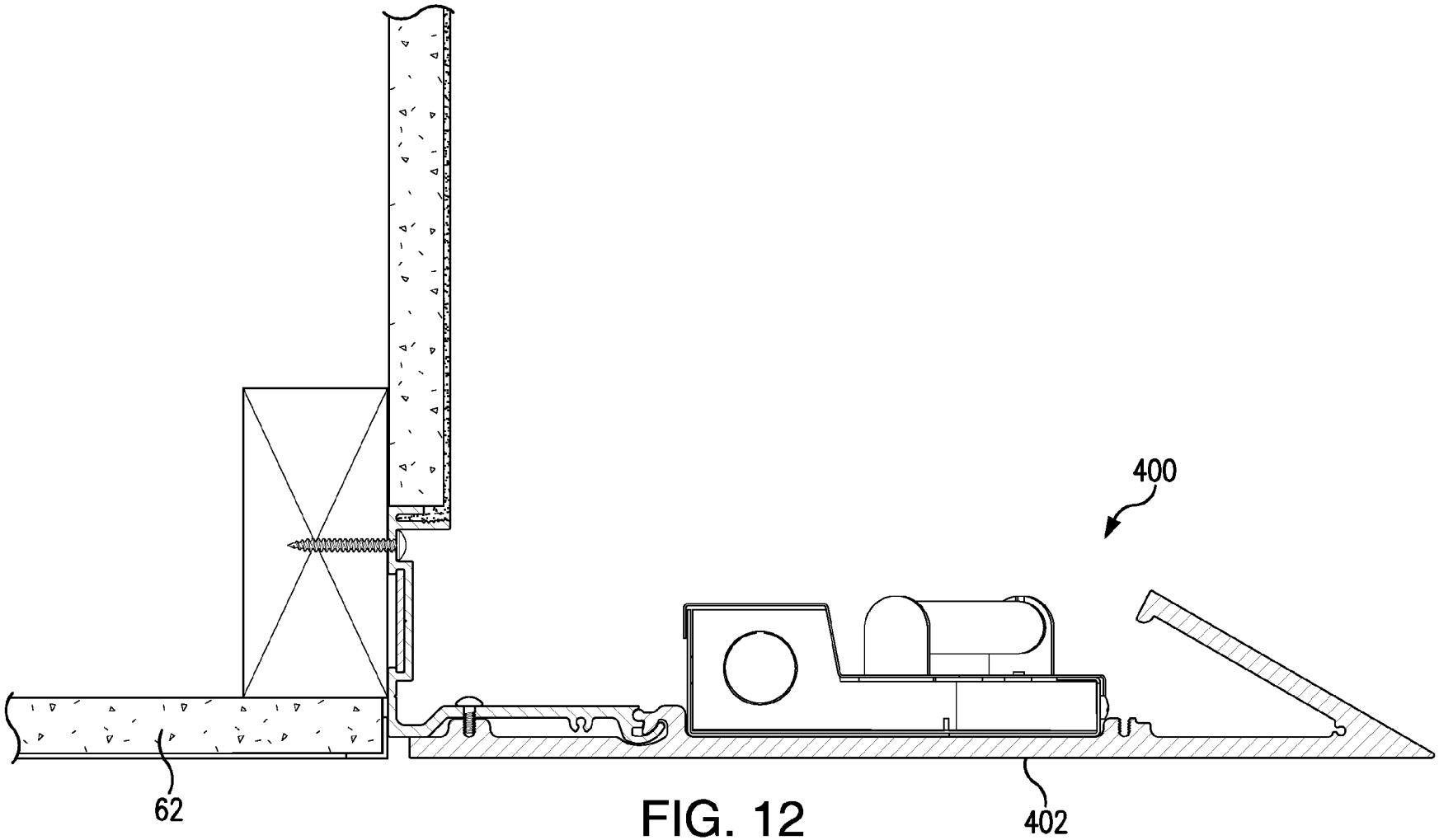
FIG. 12 is a sectional view of another alternate light fixture installed.
Figure 17:
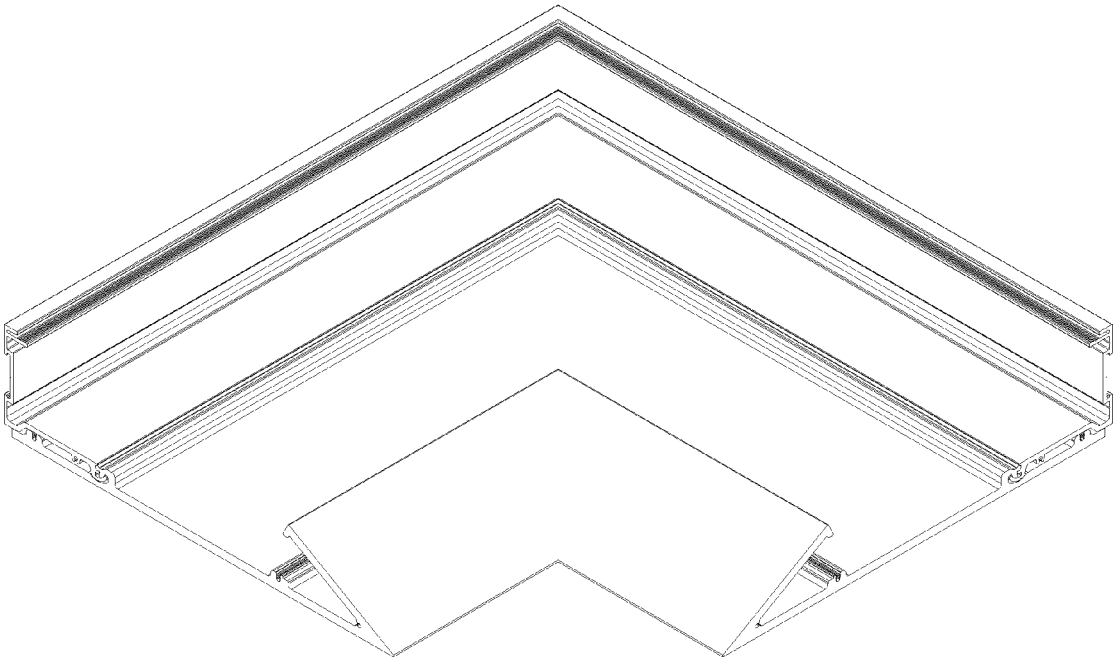
FIG. 17 is a view of a second internal corner assembly.
Figure 18:
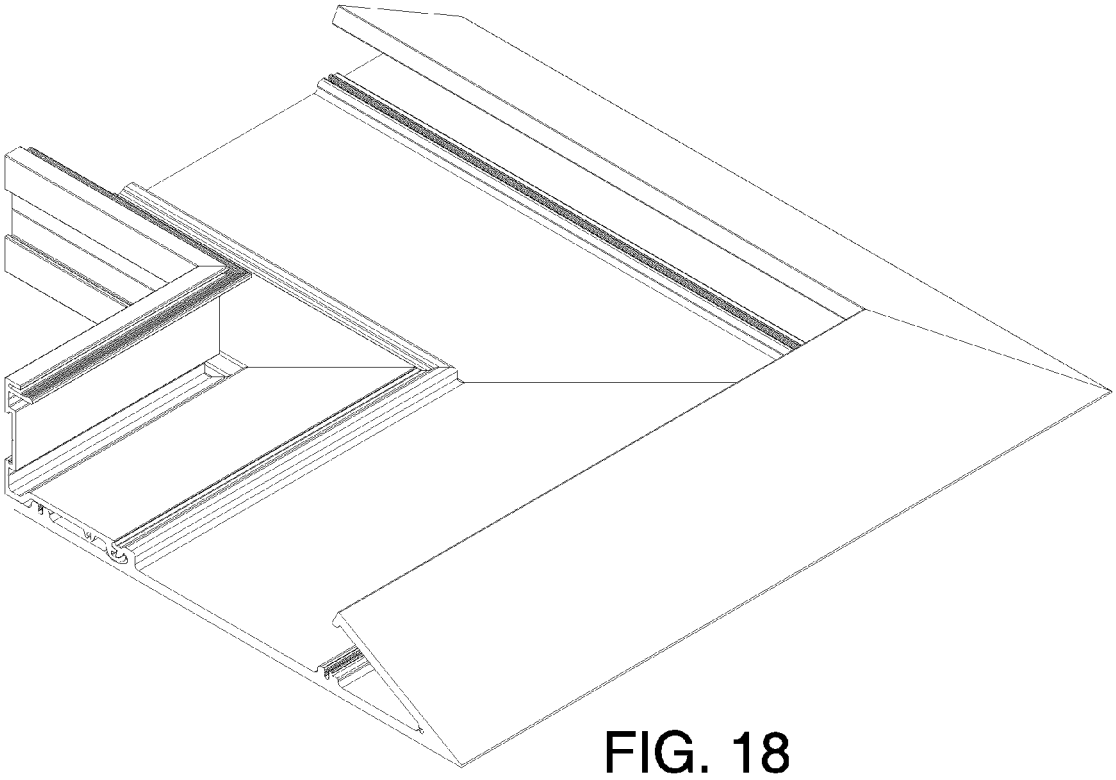
FIG. 18 is a view of a second external corner assembly.

FIGS. 17 and 18 show respective interior and exterior corner assemblies for use with the FIG. 12 fixture.

One or more embodiments of the present invention have been described. Nevertheless, it will be understood that various modifications may be made without departing from the spirit and scope of the invention. For example, various elements may be combined or further separated. Additionally, a variety of structural shapes and cooperating features of the extrusion are possible. Various other manufacturing techniques and materials may be used. Multiple bulb and multiple reflector embodiments are also possible. Architectural/design considerations may influence any particular implementation, giving rise to the possibility of mounting on non-vertical surfaces and mounting in non-horizontally extending arrays. Accordingly, other embodiments are within the scope of the following claims.

What is claimed is:

1. A light apparatus mounted to a surface of a building and comprising:

at least one elongate mounting extrusion engaged to the surface;

at least one elongate trim extrusion:

mounted to the at least one elongate mounting extrusion and extending forward therefrom;

having a forward edge; and having an upwardly and rearwardly sloping surface extending from the edge; and at least one light source mounted to at least one of the at least one elongate mounting extrusion and the at least one elongate trim extrusion.

2. The apparatus of claim 1 wherein:

the surface is a wall;

the at least one elongate mounting extrusion extends essentially horizontally along the wall; and the at least one elongate mounting extrusion is generally L-sectioned having:

a first portion along the wall; and a second portion extending forward from a lower region of the first portion and engaging the at least one elongate trim extrusion.

3. The apparatus of claim 1 wherein:

the at least one light source comprises a plurality of elongate fluorescent light bulbs.

4. The apparatus of claim 1 wherein:

an underside of the at least one trim extrusion extends generally straight horizontally rearward from the edge.

5. The apparatus of claim 1 wherein an underside of the at least one trim extrusion is characterized by:

a forward portion having a plurality of upwardly extending recesses; and an aft portion upwardly stepped relative to the forward portion.

6. The apparatus of claim 5 wherein:

a wallboard layer is accommodated by the stepped aft portion behind the forward portion; and a skim coat extends at least partially over the wallboard layer and into the recesses.

7. The apparatus of claim 6 wherein:

the wallboard layer comprises, in majority volume part, cementaceous or fibrous material or combinations thereof, and is screwed to the at least one elongate trim extrusion.

8. The apparatus of claim 1 wherein:

respective portions of the at least one elongate mounting extrusion and the at least one elongate trim extrusion form a pivot joint between the elongate mounting extrusion and the elongate trim extrusion.

9. The apparatus of claim 8 wherein:

the at least one elongate trim extrusion is locked to the at least one elongate mounting extrusion by screws.

10. The apparatus of claim 8 wherein:

the at least one elongate mounting extrusion has a stepped underside; and a rear portion of the at least one elongate trim extrusion is accommodated by the stepped underside.

11. The apparatus of claim 8 wherein:

at least one light source comprise modules mounted directly to the at least one elongate mounting extrusion.

12. The apparatus of claim 1 wherein:

the at least one elongate mounting extrusion is mounted to a forward surface of a blocking member of the building;

at least one wallboard member of the building is mounted to the blocking member above the at least one elongate mounting extrusion;

the at least one mounting extrusion has a channel; and a skim coat extends over a forward surface portion of the at least one wallboard member and into the channel.

13. The apparatus of claim 1 wherein:

the plurality of light blocking members in self-locking engagement with features of adjacent pair of said elongate mounting extrusions is positioned to block light from the light source from passing through a gap between said pair.

14. The apparatus of claim 1 wherein the plurality of light sources each comprise:

a holding element, comprising:

at least one metal support; and at least one receptacle mounted to the support; and at least one ballast positioned below at least a first of the least one metal support.

15. A light apparatus comprising:

at least one light source;

first means installable to a building wall for mounting a remainder of the apparatus to the wall; and trim means for presenting a rearwardly-diverging edge portion.

16. The apparatus of claim 15 further comprising:

second means for attaching to at least an installed trim means for blocking light passage between adjacent trim means; and third means for mounting the light source to at least one of the first means and trim means.

17. The apparatus of claim 15 wherein:

the trim means are essentially metallic extrusions; and the first means are essentially metallic extrusions.

18. The apparatus of claim 15 wherein:

the third means include metal supports to which light receptacles are mounted, the metal supports retained to the first means by a combination of interfitting and fasteners.

19. A method for assembling a light apparatus to a surface of a building comprising:

securing at least one mounting extrusion to the surface;

downwardly hinging at least one trim extrusion to the at least one mounting extrusion; and assembling a plurality of light sources to at least one of the trim extrusions and the mounting extrusions.

20. The method of claim 19 wherein:

the at least one trim extrusion has a rearwardly diverging front portion.

21. The method of claim 19 further comprising:

securing of the trim extrusions comprising screwing into the mounting extrusions.

22. The method of claim 19 wherein:

the surface is a vertical surface of a blocking member of a cove wall; and the securing the at least one mounting extrusion to the surface comprises:

screwing a first mounting extrusion to the blocking member;

assembling a connector to the first mounting extrusion;

assembling a second mounting extrusion to the connector; and screwing the second mounting extrusion to the blocking member.

23. The method of claim 19 further comprising:

securing one or more wallboard pieces comprising:

screwing at least a first wallboard piece below said mounting extrusions and trim extrusion; and screwing at least a second wallboard piece above the mounting extrusions.

24. The method of claim 23 further comprising:

applying a skim coat over a junction between the first wallboard pieces and the trim extrusions.

25. The method of claim 19 further comprising:

snap lock engagement of light blocking members across gaps between adjacent said trim extrusions.

26. A light apparatus comprising:

at least one light source;

first means installable to a vertical surface of a blocking member of a cove wall of a building wall for mounting a remainder of the apparatus to the wall and for receiving a skimcoat across a junction with a wallboard member; and trim means mountable to the first means.

27. The apparatus of claim 26 wherein the trim means provides a rearwardly-diverging edge portion.

28. A method for assembling a light apparatus to a vertical surface of a blocking member of a cove wall of a building comprising:

securing at least one mounting extrusion to the surface;

mounting at least one trim extrusion to the at least one mounting extrusion;

assembling a plurality of light sources to at least one of the trim extrusions and the mounting extrusions; and securing at least a wallboard piece above the mounting extrusions.

29. The method of claim 28 further comprising:

applying a skim coat over a junction between the wallboard piece and the mounting extrusions.

30. The method of claim 28 further comprising:

securing of the trim extrusions comprising screwing into the mounting extrusions.

31. The method of claim 28 wherein:

the securing the at least one mounting extrusion to the surface comprises:

screwing a first mounting extrusion to the blocking member;

assembling a connector to the first mounting extrusion;

assembling a second mounting extrusion to the connector; and screwing the second mounting extrusion to the blocking member.

32. The method of claim 28 further comprising:

screwing at least a second wallboard piece below said mounting extrusions and trim extrusion.

* * * * *